US008453866B2

(12) United States Patent
Kamath

(10) Patent No.: US 8,453,866 B2
(45) Date of Patent: Jun. 4, 2013

(54) CLOSURE WITH IMPROVED ROTATION-INHIBITING PROJECTIONS

(76) Inventor: Ramesh Kamath, Carmel, IN (US)

( * ) Notice: Subject to any disclaimer, the term of this patent is extended or adjusted under 35 U.S.C. 154(b) by 44 days.

(21) Appl. No.: 12/745,188

(22) PCT Filed: Nov. 26, 2008

(86) PCT No.: PCT/US2008/013167

§ 371 (c)(1),
(2), (4) Date: Sep. 3, 2010

(87) PCT Pub. No.: WO2009/073137

PCT Pub. Date: Jun. 11, 2009

(65) Prior Publication Data

US 2011/0000915 A1 Jan. 6, 2011

Related U.S. Application Data

(60) Provisional application No. 61/004,718, filed on Nov. 29, 2007.

(51) Int. Cl.
*B65D 41/04* (2006.01)
*B65D 41/34* (2006.01)

(52) U.S. Cl.
USPC ..... 220/288; 215/329; 215/331

(58) Field of Classification Search
USPC ..... 220/288; 215/331, 330, 329
See application file for complete search history.

(56) References Cited

U.S. PATENT DOCUMENTS

| | | | | |
|---|---|---|---|---|
| 5,197,620 | A | 3/1993 | Gregory | |
| 5,676,270 | A * | 10/1997 | Roberts | 215/330 |
| 5,845,798 | A * | 12/1998 | Carrier | 215/330 |
| 6,123,212 | A | 9/2000 | Russell et al. | |
| 6,889,857 | B2 | 5/2005 | Francois et al. | |
| 7,637,384 | B2 * | 12/2009 | Price et al. | 215/253 |

OTHER PUBLICATIONS

International Preliminary Report on Patentability and Written Opinion in corresponding PCT Application No. PCT/US2008/013167 dated Jun. 10, 2010.

* cited by examiner

*Primary Examiner* — Mickey Yu
*Assistant Examiner* — Niki Eloshway
(74) *Attorney, Agent, or Firm* — Wood, Phillips, Katz, Clark & Mortimer

(57) ABSTRACT

A package for carbonated beverages and the like includes a container, and a closure which can be threadably applied to the container by the provision of respective, cooperating thread formations. In order to facilitate release of gas pressure from within the package during closure removal, the present package includes at least one rotation-inhibiting projection, which can be positioned within a vent groove provided on either the container or closure of the package. Notably, a rotation-inhibiting projection in accordance with the present invention is configured vertically asymmetrically relative to a helix defined by a respective one of the thread formations of the container and closure of the package. The arrangement facilitates release of gas pressure from within the package, and further facilitates convenient manipulation and removal of the closure by consumers by minimizing removal torques for the closure.

15 Claims, 3 Drawing Sheets

CLOSURE WITH IMPROVED ROTATION-INHIBITING PROJECTIONS

TECHNICAL FIELD

The present invention relates generally to threaded plastic closures molded from polymeric materials for use on associated containers, and more particularly to a closure and container package which includes an arrangement of one or more rotation-inhibiting projections, provided either on the closure or the container, which act to facilitate the release of gas pressure from within the package, while facilitating convenient removal of the closure from the container by consumers without application of excessive torque.

BACKGROUND OF THE INVENTION

Threaded plastic closures used on containers to form packages for carbonated beverages, or otherwise pressurized products, have met with very widespread success in the marketplace. Packages of this nature typically include a closure including a molded plastic closure cap having a top wall portion, and an annular, dependent cylindrical skirt portion. The skirt portion typically includes an internal thread formation configured for thread cooperation with alike external thread formation on the associated container. The desired sealing with the container can be achieved by providing the closure with a sealing liner positioned generally adjacent the top wall portion. Closures of this type which have proven to be particularly commercially successful are disclosed in U.S. Pat. No. 4,343,754, U.S. Pat. No. 4,378,893, and U.S. Pat. No. 4,497,765, all of which are hereby incorporated by reference. For many applications, it is desirable to configure such closures for tamper-indication, such as in accordance with the teachings of the above-referenced U.S. Pat. No. 4,497,765, or in accordance with the teachings of U.S. Pat. No. 4,938,370, U.S. Pat. No. 4,978,017, and U.S. Pat. No. 5,004,112, all hereby incorporated by reference.

As noted, packages of the above-type have proven to be very commercially successful for containing carbonated contents. As such closures of this type are typically configured to facilitate venting and release of gas pressure from within the container during closure removal. In particular, it is desirable to release the gas pressure from within the container prior to disengagement of the closure thread formation from the threads provided on the neck portion of the associated container.

Heretofore, to facilitate the release of gas pressure from within such a package, both the internal thread formation of the closure, and the associated external thread formation of the container, are provided with a plurality of axially extending vent grooves, which traverse and substantially interrupt the respective thread formations. By such arrangements, gas from within the package can readily flow through the vent grooves attendant to release of the closure's seal, but prior to disengagement of the respective thread formation.

Recognizing that release of gas pressure from within a package having pressurized contents is dependent upon various factors, including the pressure and volume of gas within the package, experience has shown that it can be desirable to provide one or more rotation-inhibiting projections, such as on the closure of the package, for inter-engagement with the thread formation and vent grooves of the associated container. Such projections, sometimes referred to as "speed bumps", frictionally engage the container finish during closure removal to inhibit free rotation of the closure with respect to the container, thus facilitating release of gas pressure from within the package prior to disengagement of the respective thread formation.

While the provision of such rotation-inhibiting projections has become widespread for packages for carbonated beverages and the like, it is nevertheless desirable that plastic closures for such packages do not require relatively high levels of applied torque for removal, thus facilitating convenient manipulation and removal by consumers. Recognizing that such "removal torques" be kept desirably low, efforts have been made to configure rotation-inhibiting projections to provide the desired rotation-inhibiting effect, without undesirably contributing to high removal torques for closure removal. As will be recognized by those familiar with the art, closure designers must consider the removal torques which are ordinarily necessary for overcoming the static and dynamic friction which exists between the sealing portion of the closure and the associated container, and for overcoming the friction between the closure and container thread formations, as well as the torque which must be applied for effecting fracture or other visually discernible evidence of opening by operation of the tamper-indication feature of the package.

U.S. Pat. No. 6,123,212, hereby incorporated by reference, illustrates an arrangement of rotation-inhibiting projections for a closure which facilitates high-speed application, while providing the desired rotation-inhibiting effect to facilitate release of gas pressure from within a package having pressurized contents. The present invention seeks to provide an improved arrangement of tamper-inhibiting projections which facilitate the desired release of gas pressure, while desirably acting to minimize removal torques, thus facilitating convenient manipulation and removal of closures by consumers.

SUMMARY OF THE INVENTION

A package comprising a closure and container embodying the principles of the present invention is configured to facilitate convenient removal of the closure from the container by consumers, while facilitating the release of gas pressure from within the container prior to disengagement of the respective thread formations provided on the closure and the container. Notably, the present invention contemplates the provision of one or more rotation-inhibiting projections each having a configuration which is vertically asymmetrical relative to a helix defined by the respective thread formation of the closure or container of the package. By such an arrangement, the projection is configured to predominantly engage a portion of the thread formation of either the container or closure which minimizes the removal torque which must be applied by consumers during closure removal. Thus, the desired release of gas pressure from within the package prior to thread disengagement is desirably facilitated, while at the same time minimizing removal torque which must be applied to a closure during removal, thereby facilitating convenient manipulation by consumers.

In accordance with one illustrated embodiment, wherein one or more rotation-inhibiting projections are provided on the plastic closure of the package, the closure includes a closure cap having a top wall portion, and an annular skirt portion depending from the top wall portion. The skirt portion includes a helical, closure thread formation defining a closure thread helix, with the thread formation having a thread start at an end of the thread formation spaced furthest from the top wall portion of the closure cap. The closure thread formation is configured for cooperating threaded engagement with a helical container thread formation provided on the exterior of the neck portion of the associated container.

The closure includes at least one rotation-inhibiting projection on the inside surface of the skirt portion. As noted, each projection is configured vertically asymmetrically of the closure thread helix, so that the projection predominantly engages an upper surface of the container thread formation during removal of a closure from the container. In the preferred embodiment, the projection is asymmetrically configured relative to a radius of the closure which extends through the projection, to thereby define a guide surface oriented in a direction of the closure thread formation toward the thread start, and an interference surface oriented in a direction of the thread formation away from the thread start. In this embodiment, the projection has an irregular, generally hexahedronal configuration.

In the illustrated embodiment, the skirt portion of the closure defines at least one axially extending vent groove extending transversely of the closure thread formation. The rotation-inhibiting projection is positioned generally within the vent groove, which desirably positions the projection for cooperation with the thread formation of the associated container, while facilitating formation of the projection during molding by virtue of its disposition within the relatively flexible portion of the closure cap at the vent groove.

In an alternate embodiment, the closure cap is provided with at least one rotation-inhibiting projection positioned adjacent a lower surface of the closure thread formation. Again, the projection is preferably asymmetrically configured relative to a radius of the closure which extends through the projection, to thereby define a guide surface oriented in a direction of the closure thread formation toward the thread start, and an interference surface oriented in a direction of the thread formation away from the thread start.

In a further embodiment of the present invention, one or more rotation-inhibiting projections are provided on the container of the package, such as by disposition in a vent groove defined by the neck portion of the container. In this embodiment, the projection is also illustrated as having an irregular, generally hexahedronal configuration, although the projection is in a generally inverted orientation, as compared to the orientation when such a projection is provided in the vent groove on the closure. In a preferred form, the projection is circumferentially asymmetrically configured to thereby define a guide surface oriented in a direction of the respective thread formation toward the thread start, and an interference surface oriented in a direction of the respective thread formation away from the thread start.

Other features and advantages of the present invention will become readily apparent from the following detailed description, the accompanying drawings, and the appended claims.

BRIEF DESCRIPTION OF THE DRAWINGS

FIG. 2 is a fragmentary, elevational view of the threaded neck portion of a container of the type with which the present closure is suited for use for formation of a package such as for carbonated beverages or the like;

DETAILED DESCRIPTION

Figure 1:
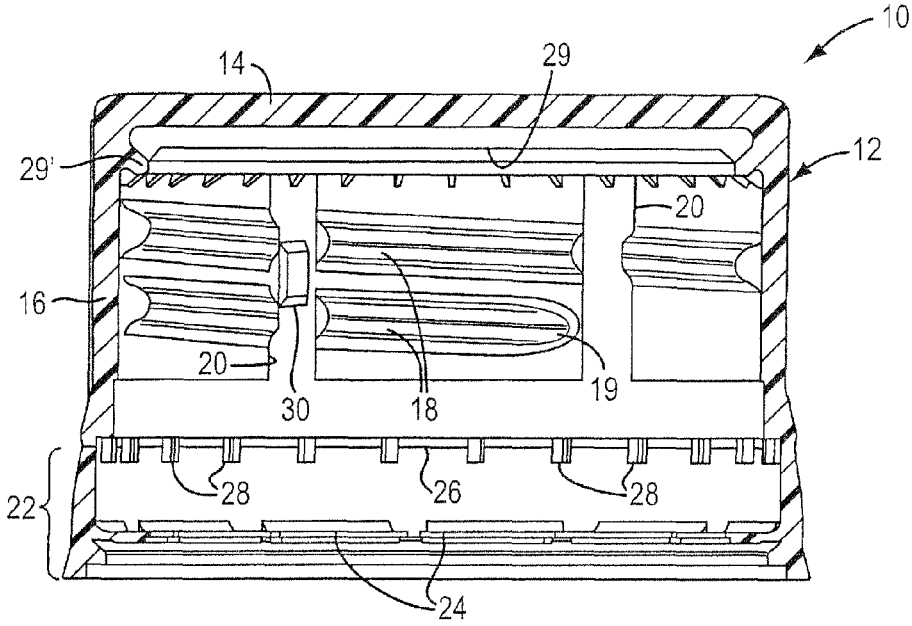
FIG. 1 is a cross-sectional view illustrating a plastic closure having a rotation-inhibiting projection embodying the principles of the present invention.

While the present invention is susceptible of embodiment in various forms, there is shown in the drawings, and will hereinafter be described, presently preferred embodiments, with the understanding that the present disclosure is to be considered as an exemplification of the invention, and is not intended to limit the invention to the specific embodiments illustrated.

With reference first to FIG. 1, therein is illustrated a plastic closure 10 having one or more rotation-inhibiting projections embodying the principles of the present invention. This type of closure is sometimes referred to as a "composite closure" by virtue of its formation with an outer shell cap, and an optional inner sealing liner. This type of closure construction has proven to be very well-suited for use on containers having carbonated or otherwise pressurized contents, to form a package therewith.

Closure 10 includes an outer molded closure cap or shell 12 having a top wall portion 14, and an annular or cylindrical skirt portion 16 depending from the top wall portion 14. The skirt portion 16 includes an internal, helical thread formation 18 which defines a closure thread helix. In the illustrated embodiment, thread formation 18 is shown in a discontinuous configuration, comprising plural thread segments, with the thread formation traversed and interrupted by axially extending vent grooves or passages 20. Vent grooves 20 facilitate release of gas pressure from within a container during removal of the closure therefrom, with release and equalization of gas pressure preferably effected prior to disengagement of thread formation 18 from the cooperating thread formation of the associated container. Thread formation 18 preferably extends about the closure at least 360°, preferably more than 360° so that the thread formation overlaps itself. Typically, thread formation 18 extends approximately 540° about the interior of the skirt portion 16.

For purposes of the present disclosure, reference will be made to the thread start, designated 19, the portion of the thread formation which is first moved into engagement with the threads in an associated container during application of the closure. The thread start is the portion of the thread formation 18 positioned furthest from top wall portion 14.

Other features of closure 10 will be recognized by those familiar with the art. The closure 10 is configured for tamper-indication, and to this end, includes an annular pilfer band 22 depending from skirt portion 16. The pilfer band 22 includes a plurality of circumferentially spaced, inwardly extending flexible projections 24 which are configured for cooperative inter-engagement with the associated container.

The pilfer band 22 is distinguished from the skirt portion 16 by a score line 26 which extends partially or completely about the closure cap. The pilfer band 22 is at least partially detachably connected to the skirt portion 16 by the provision of a plurality of circumferentially spaced frangible ribs 28 which extend between the inside surfaces of the skirt portion 16, and the pilfer band, generally spanning the score line 26. The interaction of projections 24 with an associated container during closure removal acts to fracture the frangible ribs 28, thus partially or completely separating the pilfer band 22 from the skirt portion. Readily visually discernible evidence of opening is thus provided.

In the illustrated embodiment, the closure 10 includes a sealing liner 29 positioned adjacent the inside surface of the top wall portion 14. An annular lip or shoulder 29' extends generally inwardly from skirt portion 16 to facilitate formation of liner 29 within the closure cap by compression molding.

Figure 2:
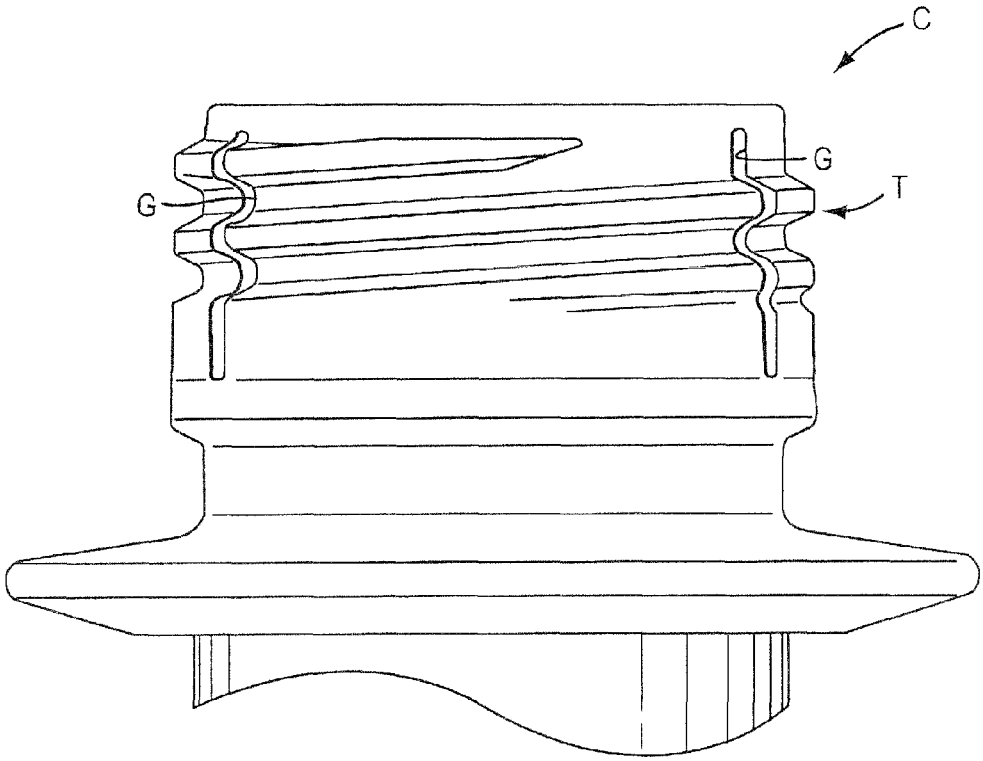

In accordance with the present invention, the package comprising the illustrated closure and container is configured to facilitate venting and release of gas pressure from within the package, particularly with it contains a carbonated beverage of the like. A container for practicing the package of the present invention can be configured in accordance with illustrated container C, shown in FIG. 2, including a threaded neck portion including an external thread formation T, defining a container thread helix, which thread formation is configured to mate with the thread formation 18 on the closure 10.

To facilitate release of gas pressure from within the container, the neck portion of the container includes at least one. and typically a plurality (i.e., four) of axially extending vent grooves or passages G formed in the neck portion of the container, traversing and generally interrupting the container thread formation T. These types of vent grooves facilitate release of gas pressure from within the container during closure removal by providing a plurality of flow paths which extend from the region of the sealing liner 29 of the closure downwardly to the lower free edge of the closure pilfer band. The vent grooves G are formed to extend into the container neck such that the grooves G are positioned inwardly of the thread formation 18 of the closure 10 when the closure is positioned on the container.

In accordance with one form of the present invention, closure 10 includes at least one, and preferably a plurality of rotation-inhibiting projections configured for cooperative inter-engagement with the thread formation T of the container C, and in particular, inter-engagement with the thread formation at the grooves G of the container C. The provision of the projections facilitates venting and release of gas pressure from within container C during closure removal, prior to disengagement of closure thread formation 18 from container thread formation T. Notably, the configuration of the rotation-inhibiting projection provides the desired rotation-inhibiting effect for facilitating gas venting, while at the same time desirably minimizing removal torques required for closure removal, thus facilitating convenient manipulation by consumers.

In this embodiment of the present invention, rotation-inhibiting projection 30 is provided on the inside surface of skirt portion 16 of closure 10, with the illustrated form of closure 10 configured such that the projection 30 is positioned generally within one of the axially extending vent grooves 20 defined by the skirt portion of the closure. In a presently preferred embodiment, a plurality of the rotation-inhibiting projections 30 are provided on the inside surface of the skirt portion 16 of the closure, such as by disposition in one or more of the axially extending vent grooves 20 of the closure cap. However, it is to be understood that disposition of the projection 30 within the vent grooves is not required for practice of the present invention. However, because the skirt portion 16 of the closure cap exhibits relative flexibility in the region of the vent grooves 20, disposition of the projections 30 in the vent grooves facilitates formation of the projections and the closure cap, including removal from an associated mold.

As illustrated, projection 30 is positioned generally vertically intermediate overlapping segments of the closure thread formation 18. The projection 30 can be otherwise positioned to provide the desired engagement with the container thread formation T.

Figure 3:
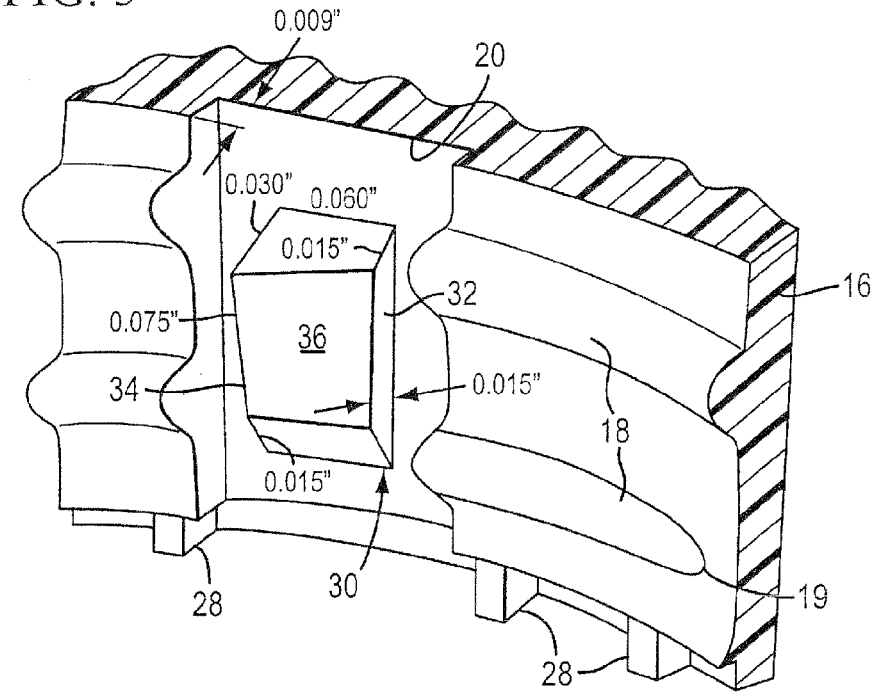
FIG. 3 is a fragmentary, perspective view illustrating a rotation-inhibiting projection in accordance with this embodiment of the present invention'
Figure 4:
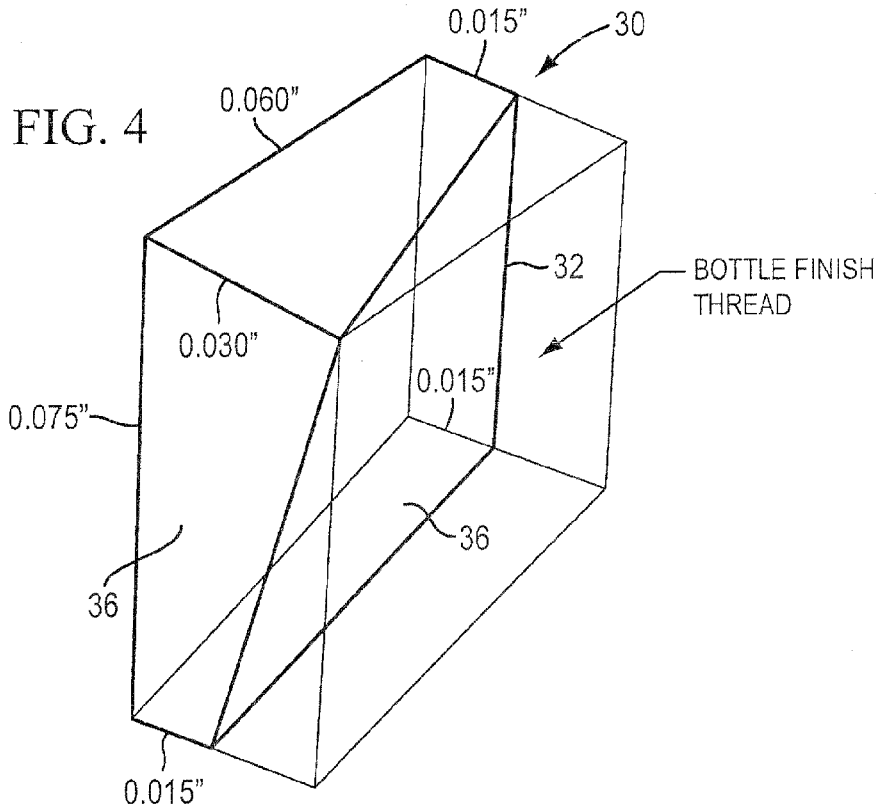
FIG. 4 is a diagrammatic view illustrating the rotation-inhibiting projection shown in FIG. 3.

With particular reference to FIGS. 3 and 4, the unique configuration of rotation-inhibiting projection 30 is illustrated. As shown, the projection 30 is preferably provided with an irregular, generally hexahedronal configuration, formed integrally on the inside surface of skirt portion 16 within the vent groove 20. In a typical 28 mm plastic closure, such as for carbonated beverages, the vent groove 20 has a depth on the order of 0.009 inches, with the projection 30 extending inwardly from the base of the vent groove toward the centerline or axis of the closure cap. Typical dimensions for a projection 30 provided on a 28 mm closure cap are illustrated in FIGS. 3 and 4, with FIG. 4 being a diagrammatic view illustrating the hexahedronal configuration of the projection 30.

As will be appreciated, the projection 30 is configured vertically asymmetrically with respect to a helix defined by the thread formation 18, that is, a relatively greater portion or mass of the projection 30 is positioned upwardly of the helix, toward the top wall portion of the closure cap. The radial thickness of the projection 30 increases over a vertical extent of the projection in a direction toward the top of the closure cap. By this arrangement, the projection 30 is configured to predominantly engage an upper surface of the container thread formation T during removal of the closure from the container. Configuring the projection 30 in this manner desirably acts to minimize removal torque required during closure removal.

In the preferred embodiment, the projection 30 is further asymmetrically configured relative to a radius of the closure through the projection, to thereby define a guide surface 32 oriented in a direction of the closure thread formation toward the thread start 19, and an interference surface 34, generally opposite the guide surface 32, oriented in a direction of the thread formation away from the thread start 19. This arrangement of the guide surface 32, having a relatively shallow slope or angle, and interference surface 34, having a more pronounced or abrupt shape, facilitates application of the closure to an associated container, with the container thread initially engaging the projection 30 generally at guide surface 32. The relatively steep and abrupt interference surface 34 provides the desired rotation-inhibiting effect attendant to removal of the closure from the associated container, as the interference surface coacts with and engages the container thread formation, particularly at vent grooves G. In the illustrated embodiment, the projection 30 further defines an inwardly facing surface 36 positioned between the guide surface 32 and the interference surface 34.

This specific configuration of the projection 30 can be varied from the generally hexahedronal configuration illustrated herein, while keeping with the principles of the present invention. In this illustrated embodiment, the projection 30 has a lower surface that is rectangular, an upper surface that is trapezoidal, with the guide surface 32 being trapezoidal, and the interference surface 34 being an irregular quadrilateral.

Thus, the above-described embodiment provides a rotation-inhibiting projection, or "speed bump", having a relatively complex geometry, which is configured so that there is little or minimum resistance from the container finish to enter the closure, as well as during normal closure removal. The projection 30 is also configured with a sharp or deeper edge, at interference 34, to catch and engage the container finish thread formation if the closure free spins. If the closure is opened normally, there is little or minimum drag during the opening. As noted, the projection 30 can be located in the vent groove 20 which is a relatively flexible region of the closure, facilitating manufacture.

In operation, as the container finish thread formation goes over the "minimum size" portion of the projection 30, there is little or minimum drag created. However, while opening the closure, if there is a sudden release, the container thread catches the sharp and deeper edge of interference surface 34 of the complex geometry of the projection 30, thereby providing very effective stoppage of free spinning of the closure.

A rotation-inhibiting projection such as 30 can be provided as a single projection, or as a plurality of projections (i.e., two, three, four, six, etc.), that is, as many as are required to achieve the desired opening performance. The projections can be positioned strategically to provide the optimal engagement and cooperation with the container thread, for example, by disposition of one of the projections in close association with the thread start in the first vent groove.

Notably, comparative analysis of a closure having a complex geometry rotation-inhibiting projection such as described above exhibited a removal torque average of 12.25 inch-pounds, while a closure having conventional rotation-inhibiting projections exhibited an average removal torque of 13.75 inches-pounds. Comparative testing, by which a predetermined amount of rotational energy is applied to spin the closure, showed enhanced closure opening performance, with a standard closure exhibiting 301 degrees, while the closure embodying the principles of the present invention exhibiting 267 degrees (a lower value in this test is preferred).

While the configuration of the rotation-inhibiting projection configured in accordance with the principles disclosed herein can be widely varied, by virtue of the vertical asymmetry of the projection, the projection can be considered "top heavy". The desired effect is to predominantly engage the upper surface of the associated container thread, by essentially providing a projection which "fills the gap" between the lower surface of the profile of the closure thread, and the upper surface of the container thread. As such, it may be desirable for some applications to configure the projection so that it only engages the upper surface of the associated container thread.

Figure 5:
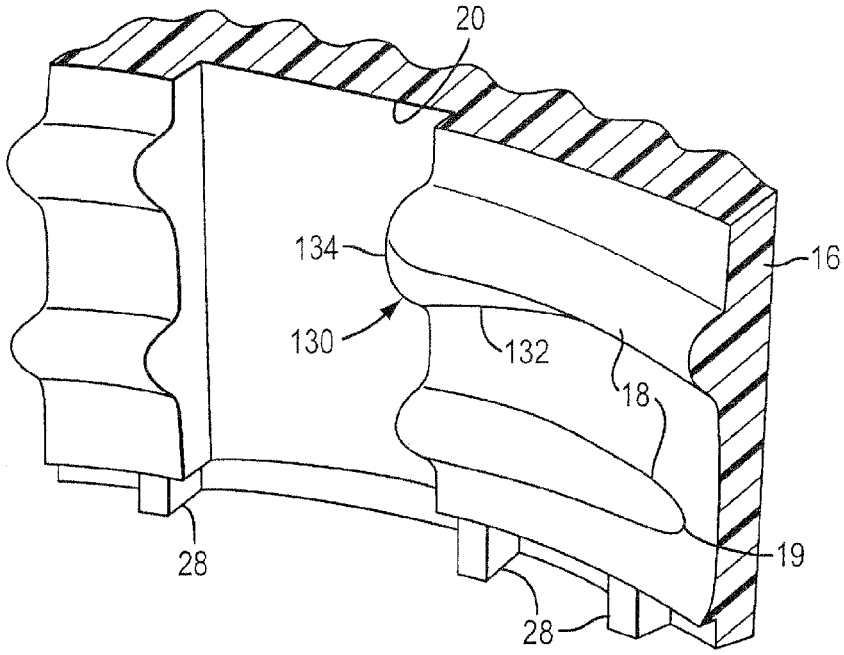
FIG. 5 is a fragmentary, perspective view similar to FIG. 3 illustrating an alternate embodiment of a closure having a rotation-inhibiting projection in accordance with the present invention.

An alternate embodiment of the present invention is illustrated in FIG. 5, wherein a rotation-inhibiting projection 130 is provided on the inside surface of skirt portion 16, adjacent to a lower surface of the closure thread formation 118. Again, as will be appreciated, projection 130 is configured vertically asymmetrically of the closure thread helix, so that the projection predominately engages an upper surface of the container thread formation T during removal of the closure from the associated container. In this embodiment, the projection 130 substantially engages only the upper surface of the container thread formation T.

As in the previous embodiment, projection 130 is preferably asymmetrically configured relative to a radius of the closure through the projection, to thereby define a guide surface 132 oriented in a direction of the closure thread formation toward the thread start 19, and an interference surface 134, positioned generally opposite guide surface 132, oriented in a direction of the thread formation away from the thread start 19. Again, the specific number of the projections 130 provided on the closure cap can be varied in accordance with the principles disclosed herein, depending upon the rotation-inhibiting effect that is desired, while at the same time avoiding relatively high removal torques to facilitate closure removal by consumers.

Figure 6:
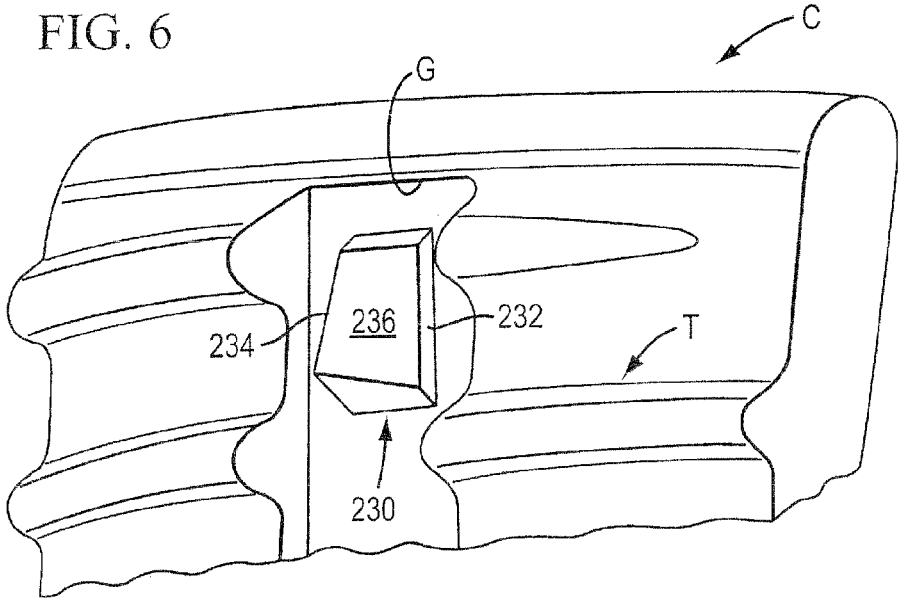
FIG. 6 is a fragmentary, perspective view of a further embodiment of the present invention, wherein a rotation-inhibiting projection is provided on the container of the present package.

While the above-described embodiments of the present invention have provided the disclosed rotation-inhibiting projections on the inside of the closure of the present package, it is within the purview of the present invention that a rotation-inhibiting projection embodying the principles of the present invention can be provided on the container of the present package. Such an arrangement is illustrated in FIG. 6, wherein a rotation-inhibiting projection 230 embodying the principles of the present invention is provided generally within the vent groove G of container C. Like the first embodiment disclosed herein, projection 230 has an irregular, generally hexahedronal configuration, although it will be recognized that the projection 230 is in a relatively inverted orientation to that of projection 30 described hereinabove. As in the previous embodiments, projection 230 is configured vertically asymmetrically of a helix defined by the respective thread formation, and is preferably asymmetrically configured relative to a radius of the container extending through the projection to thereby define a guide surface 232 oriented in a direction of the container thread formation toward the thread start, and an interference surface 234 oriented in a direction of the formation away from the thread start. In the illustrated embodiment, the projection 230 includes an outwardly facing surface 236 extending generally between guide surface 232 and interference surface 234.

In distinction from the previously-described embodiments, projection 230 is configured to predominantly engage a lower surface of the closure thread formation during removal of the closure from the container, thus providing the desired rotation-inhibiting effect to facilitate release of gas pressure from within the package, while at the same time minimizing removal torques to facilitate manipulation of the closure for removal by consumers.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A package, comprising:

a container having a neck with an external helical thread formation; and a closure for the container, the closure having a top and bottom and a radius and comprising:

a plastic closure cap including a top wall portion, and an annular skirt portion depending from said top wall portion, said skirt portion including a helical, closure thread formation defining a closure thread helix, and having a thread start at an end of said closure thread formation space furthest from said top wall portion, said closure thread formation being configured for cooperating threaded engagement with the external helical thread formation on said container, said closure including at least one rotation-inhibiting projection on the inside surface of said skirt portion configured vertically asymmetrically of said closure thread formation, said rotation-inhibiting projection having a radial thickness that increases over a vertical extent of the projection toward the top of said closure so that said projection predominantly engages an upper surface of said container external helical thread formation during removal of said closure from said container.

2. A package in accordance with claim 1, wherein:
said projection is asymmetrically configured relative to a radius of said closure through said projection to thereby define a guide surface oriented in a direction of said closure thread formation toward said thread start, and an interference surface oriented in a direction of said thread formation away from said thread start.

3. A package in accordance with claim 2, wherein:
said projection further defines an inwardly facing surface positioned between said guide surface and said interference surface.

4. A package in accordance with claim 2, wherein:
said projection is positioned adjacent to a lower surface of said closure thread formation.

5. A package in accordance with claim 1, wherein:
said projection has an irregular, generally hexahedronal configuration.

6. A package in accordance with claim 5, wherein:
said projection has a lower surface that is rectangular, an upper surface that is trapezoidal, a trapezoidal guide surface oriented in a direction of said closure thread formation toward said thread start, and an irregular quadrilateral interference surface oriented in a direction of said closure thread formation away from said thread start.

7. A package in accordance with claim 1, wherein:
said skirt portion of said closure defines at least one axially extending vent groove extending transversely of said closure thread formation,
said projection being positioned generally within said vent groove.

8. A package, comprising:
a container have a neck portion defining an open mouth, and having an external, helical thread formation thereon; and
a closure having a top and bottom, a radius, a top wall portion and a depending skirt portion having an internal, helical thread formation for mating, threaded engagement with the external thread formation of said container, said closure thread formation defining a closure thread helix, and having a thread start at an end of said thread formation space furthest from said top wall portion, said closure thread formation being configured for cooperating threaded engagement with said helical container thread formation on said container,
said closure including at least one rotation-inhibiting projection on the inside surface of said skirt portion configured vertically asymmetrically of said closure thread formation,
said projection having a radial thickness that increases over a vertical extent of said projection in a direction toward the top of said closure so that said projection predominantly engages an upper surface of said container external helical thread formation during removal of said closure from said container.

9. A package in accordance with claim 8, wherein:
said projection is asymmetrically configured relative to a radius of said closure through said projection to thereby define a guide surface oriented in a direction of said closure thread formation toward said thread start, and an interference surface oriented in a direction of said thread formation away from said thread start.

10. A package in accordance with claim 9, wherein:
said skirt portion of said closure defines at least one axially extending vent groove extending transversely of said closure thread formation,
said projection having an irregular, generally hexahedronal configuration and being positioned generally within said vent groove.

11. A package in accordance with claim 9, wherein:
said projection is positioned adjacent to a lower surface of said closure thread formation.

12. A package having a top and bottom, comprising:
a container have a neck portion defining an open mouth, and having an external, helical thread formation thereon, said container thread formation having a thread start at an end of said thread formation space furthest from said open mouth of said container,
a closure having a top wall portion and a depending skirt portion having an internal, helical thread formation for mating, threaded engagement with the external thread formation of said container, said closure thread formation having a thread start at an end of said thread formation space furthest from said top wall portion, said closure thread formation being configured for cooperating threaded engagement with a helical container thread formation on said container,
at least one of said skirt portion of said closure and said neck portion of said container defining at least one axially extending vent groove extending transversely of said the respective thread formation,
said container neck and closure each having a radius,
said package including at least one rotation-inhibiting projection positioned generally within said vent groove and configured vertically asymmetrically of a helix defined by the respective one of said thread formations,
said projection having a radial thickness that increases over a vertical extent of said projection in a direction toward the top of the package so that the projection predominantly engages an upper surface of the thread formation that the projection engages during removal of said closure from said container.

13. A package in accordance with claim 12, wherein:
said projection has an irregular, generally hexahedronal configuration.

14. A package in accordance with claim 12, wherein:
said projection is circumferentially asymmetrically configured to thereby define a guide surface oriented in a direction of said respective thread formation toward the thread start thereof, and an interference surface oriented in a direction of said respective thread formation away from the thread start thereof.

15. A package in accordance with claim 12, wherein:
said container neck portion defines said vent groove, and said projection is positioned on said neck portion generally within said vent groove of said container.

* * * * *